US005984671A

United States Patent [19]

Dutta et al.

[11] Patent Number: 5,984,671

[45] **Date of Patent: *Nov. 16, 1999**

[54] SEALING DEVICE USEFUL FOR PROVIDING AIR-SEAL SELF-CONTROLLED DISCHARGE OF PRODUCT FROM A PROCESS EQUIPMENT SUCH AS A VERTICAL SHAFT KILN

[75] Inventors: Dilip Kumar Dutta; Wahid Ahmed; Pranab Barkakati; Jayanta Jyoti Bora; Subodh Chandra Kalita; Ajoy Barkataki; Prabhat Chandra Goswami; Umesh Chandra Borah, all of Assam, India

[73] Assignee: Council of Scientific & Industrial Research, New Delhi, India

[ * ] Notice: This patent issued on a continued prosecution application filed under 37 CFR 1.53(d), and is subject to the twenty year patent term provisions of 35 U.S.C. 154(a)(2).

[21] Appl. No.: 08/659,959

[22] Filed: Jun. 7, 1996

[51] Int. Cl.[6] ..... F27D 1/08

[52] U.S. Cl. ..... 432/95; 432/96; 432/97; 432/98; 432/101; 432/239; 432/242; 110/101 CD; 110/165 R

[58] Field of Search ..... 432/95, 96, 97, 432/98, 99, 100, 101, 102, 239.242; 110/101 CD, 165 R

[56] References Cited

U.S. PATENT DOCUMENTS

| | | | |
|---|---|---|---|
| 3,822,657 | 7/1974 | Midkiff | 110/101 CD |
| 3,933,103 | 1/1976 | Mikkelsen | 110/165 R |
| 4,445,628 | 5/1984 | Cain | 110/101 CD |
| 4,513,671 | 4/1985 | Eshleman | 110/101 CD |
| 4,697,532 | 10/1987 | Furukawa et al. | 110/101 CD |
| 5,595,482 | 1/1997 | Parsons | 432/95 |

*Primary Examiner*—Teresa Walberg
*Assistant Examiner*—Jiping Lu
*Attorney, Agent, or Firm*—Morgan & Finnegan, L.L.P.

[57] ABSTRACT

This invention relates to a sealing device useful for attachment to a process equipment such as vertical shaft kiln (VSK) for providing air-seal self-controlled discharge of product from the said equipment, which comprises a chamber (1) having at its top end an inlet (3) with flange (2) for fitting to the discharge chute of a process equipment and a discharge outlet (16) at its bottom end, the said chamber being provided with a partition wall (4) having an inlet gate (5) & a discharge gate (6) hinged to its top & bottom respectively, the free ends of the hinged gates being such as to sit on means (7) and (8) to provide air seal, means (9,10,11,12,13,14,15,17,18,19,20& SOL) being provided for simultaneous operation of the inlet & discharge gates, the said means [9(*a*) & (*b*) and SOL] being connected to a control circuit for actuating the movement of the gates, the discharge outlet being fitted onto a volumetric discharge unit (21) provided with means (22) for measuring the quantity of product discharge.

7 Claims, 4 Drawing Sheets

SEALING DEVICE USEFUL FOR PROVIDING AIR-SEAL SELF-CONTROLLED DISCHARGE OF PRODUCT FROM A PROCESS EQUIPMENT SUCH AS A VERTICAL SHAFT KILN

FIELD OF THE INVENTION

This invention relates to a sealing device useful for providing air-seal self-controlled discharge of product from a process equipment like vertical shaft kiln. The discharge device of the present invention can be used for controlled discharge of any granulated/powdered material like fertilisers, food grains, minerals etc. In addition, the device of the present invention can be very effectively used in devices wherein counter current air is used in the process either for combustion or for cooling.

PRIOR ART OF THE INVENTION

In the process of manufacture of certain products like cement, the infeed homogenized raw materials require sintering for chemical transformation. For sintering of raw materials, air is to be provided uniformly with certain predetermined pressure. When the process is continuous, continuous supply of air with predetermined pressure and volume become a requirement for smooth functioning of the equipment. However, the hitherto used discharge devices do not fulfill the above requirements satisfactorily.

The known air locking discharge systems are (a) rotary vane system; (b) two or three intermittently filling and discharging with gates operated by crank, cam or any other device; and (c) a single chamber with a gate intermittently opened or closed for charging or discharging operated in batch. These known devices are basically chambers containing gates or rotary vanes which alternately open or close to facilitate discharge clinkers and blocking leakage or air supplied to the kiln. However, they are not useful for efficient continuous operation to meet the process requirements.

For example, in this regard, it may be cited with vertical shaft kiln, for the discharge of clinkers produced in the kiln an air lock discharge assembly in the form of gates or rotary vanes provided with two or three chambers as shown in FIG. 1(*a*) and FIG. 1(*b*) of the accompanying drawings. These gates alternatively open or close to facilitate discharge of clinkers and blocking leakage of air supplied to the kiln for necessary combustion. FIG. 1(*a*) and FIG. 1(*b*) of the drawings accompanying this specification, wherein clinker discharges through a two chamber rotary vane type or three chamber air lock discharge system consisting of two hollow cylindrical chambers connected to each other in such a way that material can come to the next chamber while the rotors discharge the materials. The rotors consist of horizontal shafts having four vains of slightly lesser diameter than the hollow cylinders. The vains thus connected to shaft makes four chambers for holding materials to be discharged. These rotors are mounted on bearings fitted to end closures of the hollow cylinders. The rotors are driven by electrical motors through chain sprocket system. Similarly, the three compartment air lock discharge system consist of three individual boxes of rectangular cross-section having individual doors which alternately open and close to facilitate the exit of the clinkers while blocking the air passage.

The usual drawback in these systems is that very often clinker get stuck up and also due to very abrasive nature of such clinker, the vane of the rotors or gates get erroded and due to this leakage of air with heavy dust (pollution of environment) is a common phenomena in these systems.

There are other devices like material block tube as shown in FIG. 1(*c*) of the accopanying drawings wherein a constant head of clinker is maintained inside the material block tube to prevent air leakage. However, resistance offered to air by the long column of clinker above the grate is always greater than the bed level of clinkers inside the material block tube. Due to this, considerable amount of air is lost resulting insufficient air for actual sintering process and also cause serious dust pollution.

OBJECTS AND DETAILED DESCRIPTION OF THE INVENTION

The main object of the present invention is to provide a sealing device useful for providing air-seal self-controlled discharge of product from a process equipment such as vertical shaft kiln which obviates the above noted drawbacks.

Other objects of the present invention are to provide (i) A twin chamber with hydraulically operated powerful gate which avoids air leakage completely.

(ii) Controlling the opening and closing of discharge gates within with chamber by an electronic circuit having an LDR sensor.

(iii) Providing cumulative discharge rate recorder in built which gives both cumulative and instant discharge rate.

(iv) Providing a volumetric discharge mechanism at the bottom near single outlet from twin chamber assembly to avoid further dust emission.

(v) To facilitate fitting the discharge device to any of process equipment such as vertical shaft kiln, where air leakage with discharge of product is expected.

The above-mentioned objectives of the present invention are achieved by a single kit below the vertical shaft kiln or any other process equipment for air lock discharge which will operate automatically with all monitor, electronic circuit and sensor to deliver product without air leakage and dust pollution, with calibrated amount of required discharge.

The device of the present invention also ensures proper air distribution with desired/optimum air pressure required for combustion or other requirement of this process in the process equipment like vertical shaft kiln.

The device of the present invention when attached at the lower part of an equipment such as vertical shaft kiln (VSK) will provide complete air seal thereby preventing air leakage.

The invention is particularly described with reference to a vertical shaft kiln and is described with reference to the drawings accompanying this application and this should not be considered to restrict the scope of the invention.

In the drawings:

FIG. 1(*b*) shows another prior art air lock discharge assembly having gates and three chambers.

FIG. 1(*c*) shows a prior art material block tube.

FIG. 2(*b*) shows the general layout of the control circuit diagram of the device of the invention.

FIG. 2(*c*) shows the arrangement of door fittings.

FIG. 2(*d*) shows circuit diagram for the device.

FIG. 2(*e*) shows control circuit used for material level control inside material block tube (MBT).

Figure 1A:
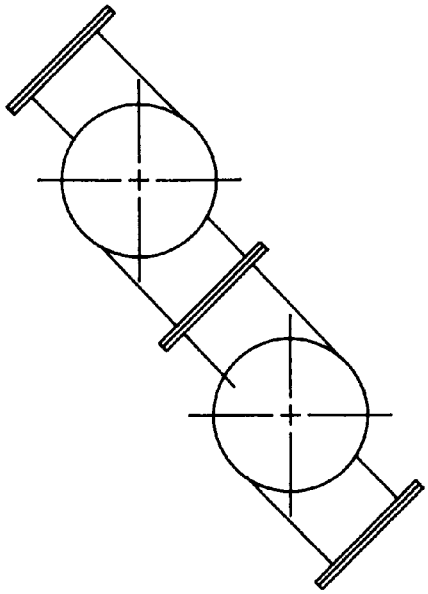
FIG. 1a PRIOR ART
FIG. 1(*a*) shows a prior art air lock discharge assembly having rotary vanes and two chambers.
Figure 1B:
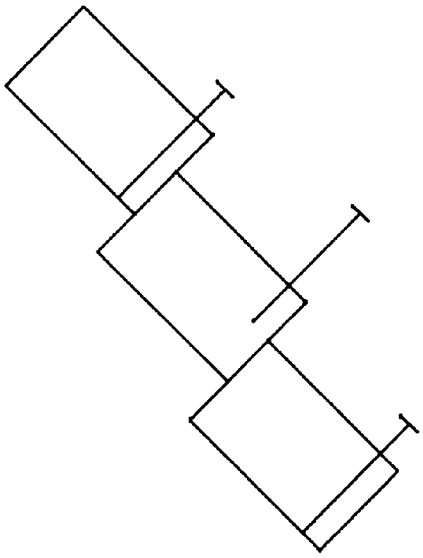
FIG. 1b PRIOR ART
Figure 1C:
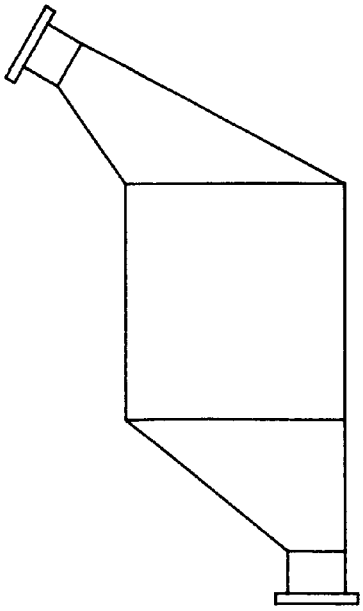
FIG. 1c PRIOR ART
Figure 2A:
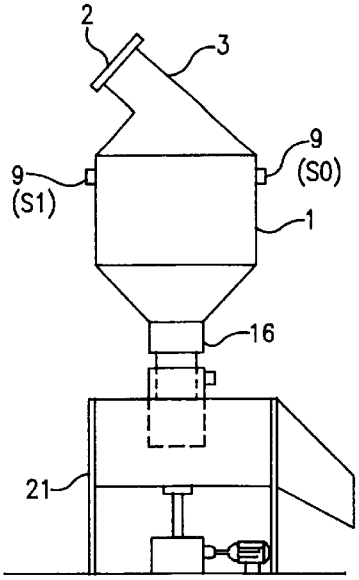
FIG. 2(*a*) shows the full elevation of general assembly & details of individual operating part of the device of the invention.
Figure 2C:
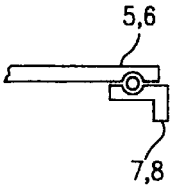
Figure 2B:
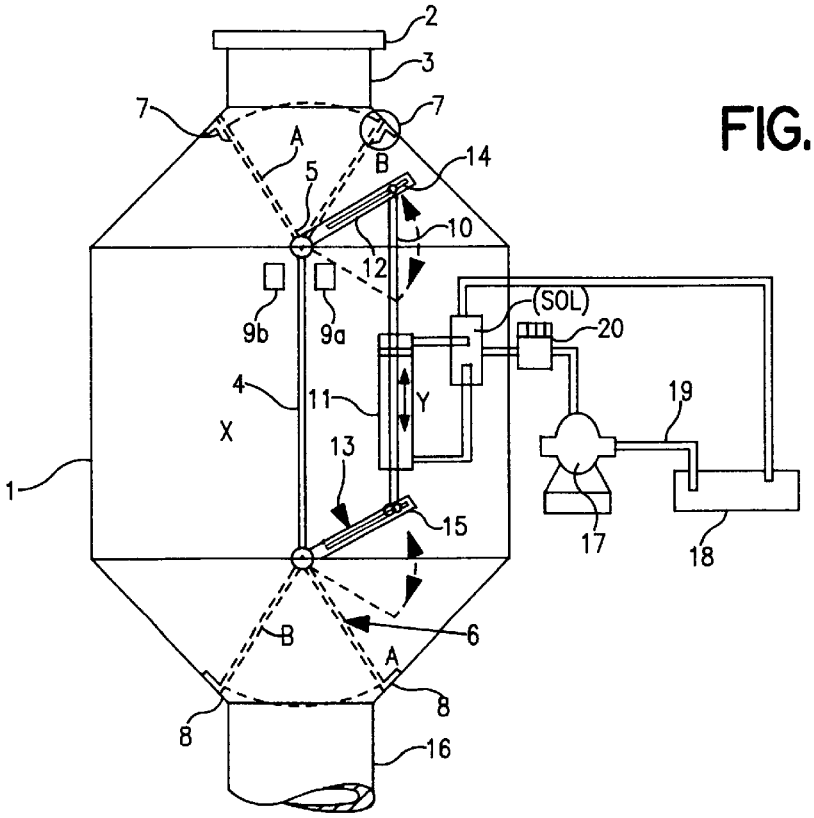
Figure 2D:
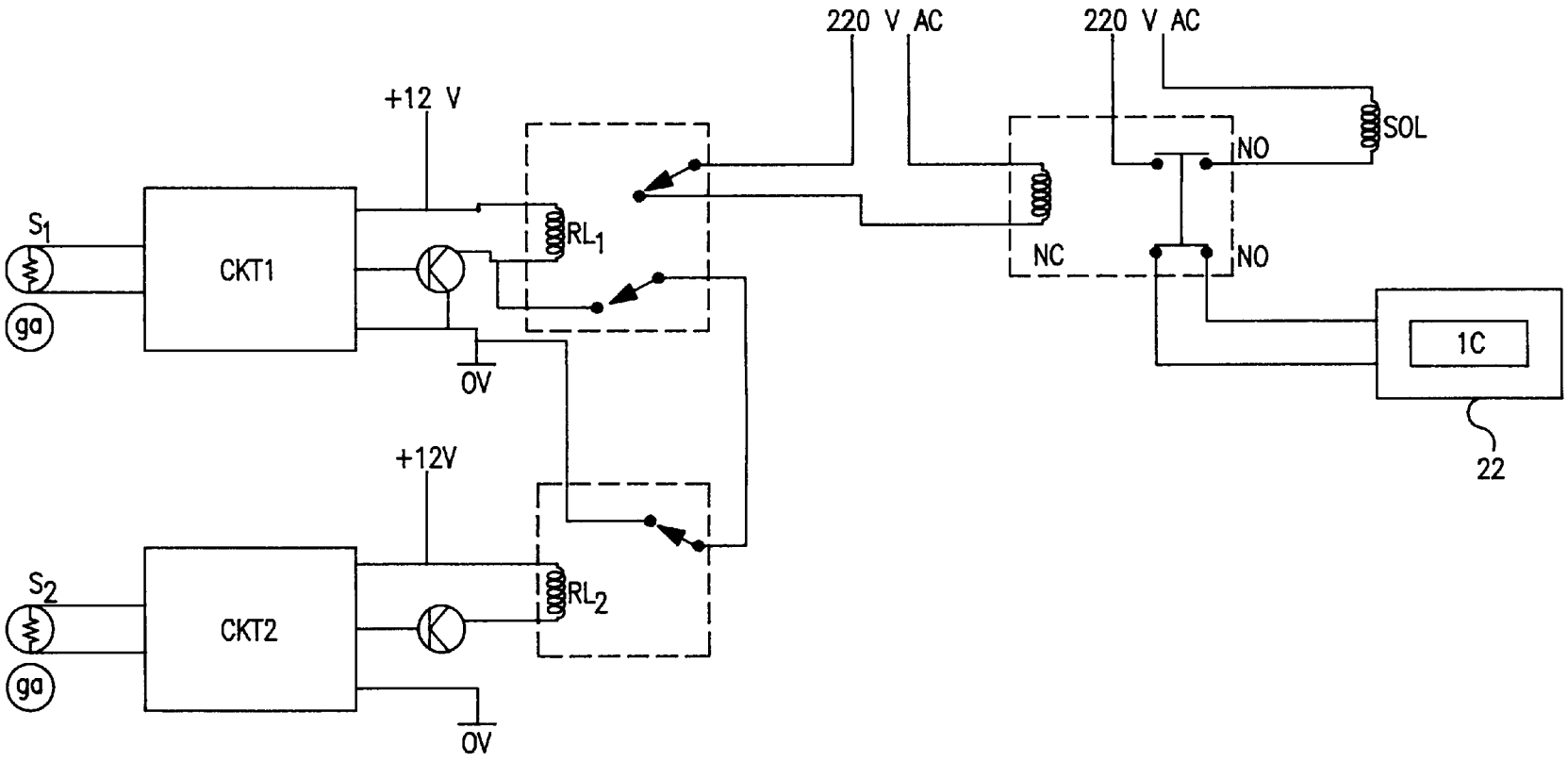
Figure 2E:
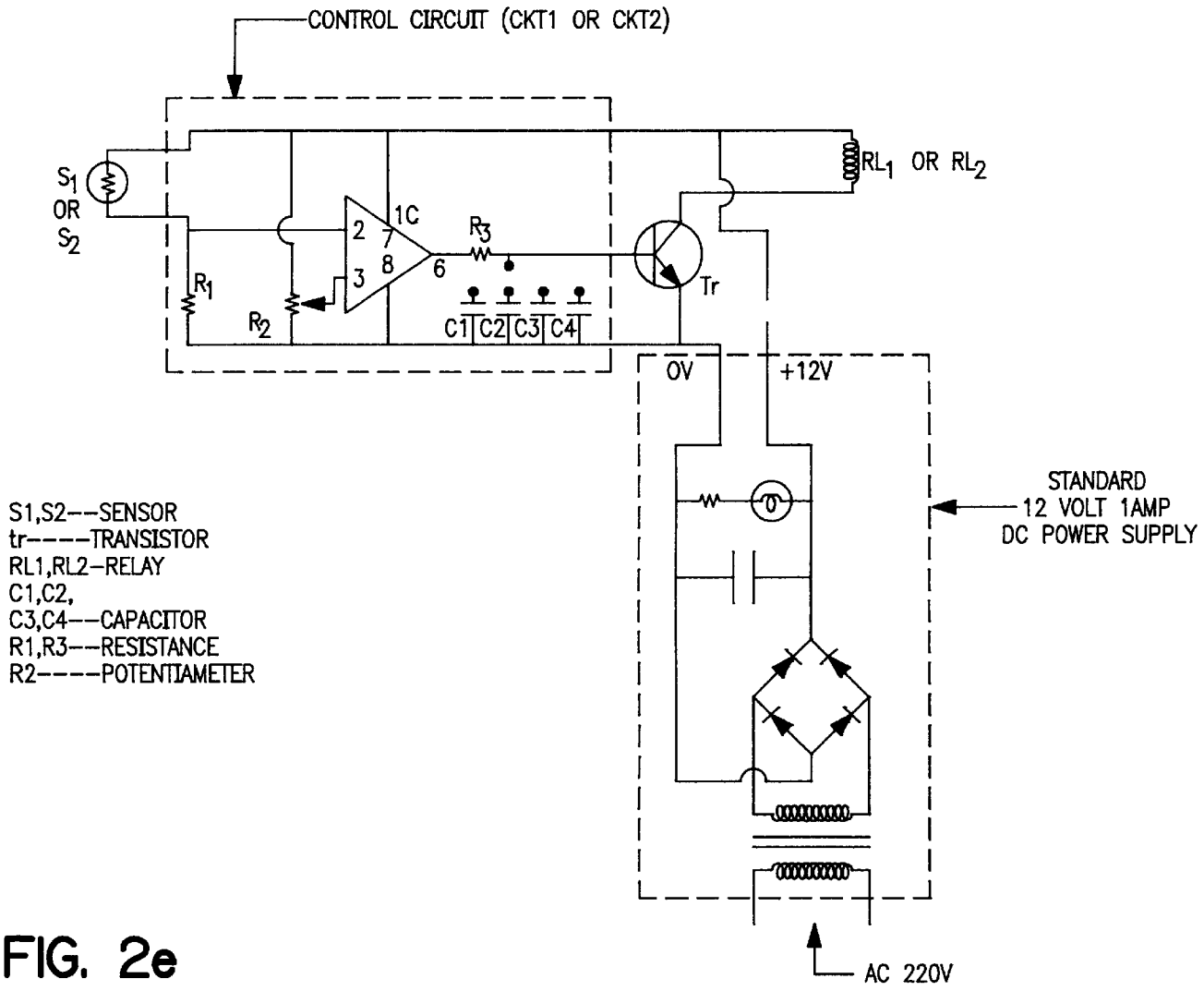

Accordingly, the present invention provides a sealing device usefit for providing air-seal self-controlled discharge of product for attachment to a process equipment such as vertical shaft kiln (VSK) from the said equipment which comprises a chamber (1) having at its top end an inlet (3) with flange (2) for fitting to the discharge chute of a process equipment and a discharge outlet (16) at its bottom end, the said chamber being provided with a partition wall (4) having an inlet gate (5) & a discharge gate (6) hinged to its top & bottom respectively, the free ends of the hinged gates being such as to sit on means (7) and (8) to provide air seal, means (9,10,11,12,13,14,15,17,18,19,20& SOL) being provided for simultaneous operation of the inlet & discharge gates, the said means [9(*a*) & (*b*) and SOL] being connected to a control circuit for actuating the movement of the gates, the discharge outlet being fitted onto a volumetric discharge unit (21) provided with means (22) [ref. FIG. 2(*d*)] for measuring the quantity of product discharge.

The discharge chamber (1) of the device having flange (2) is fitted to discharge chute of vertical shaft kiln or other process equipment with gasket. Product passes from discharge chute of vertical shaft kiln or other process equipment through single nozzle (3) enters to one of the chambers (Y) of twin chamber (1) partitioned by a wall (4). As shown in FIG. 2(*b*) of the accompanying drawings, the hydraulic system will operate to close the gates (5) & (6) sitting on seats (7) & (8) (ref. FIG. 2(*c*)). At this position, the right hand side of the chamber (Y) as shown in FIG. 2(*b*) starts filling till the predetermined required level is reached with the product. The moment the product has reached the predetermined level, the LDR source (SO) is intercepted and the sensor (S1) (ref. FIG. 2(*d*)) senses the level of the material and CKT1 closes the relay (RL1). During closing period of relay (RL1), the mains contactor (MC) is also on, and activates the solenoid (SOL), which in turn operates the gate to move to position (B) as indicated by dotted line in FIG. 2(*b*). When the sensor (S1) sends signal through circuit (CKT1) shown in FIG. 2(*d*) which will actuate the solenoid operated hydraulic valve (SOL) and. hydraulic fluid will consequently actuate the control rod (10) in the cylinder (11). The control rod (10) in turn will actuate slotted cranks (12) & (13) through pin joints (14) & (15). Then gate (5) & (6) will move to position (B) at top and bottom. This will enable for discharge of product through nozzle (16). In this process, material filled up in chamber (Y) will get discharged through nozzle (16) while in chamber (X) the filling process will continue. The process of filling and discharge will thus continue. The fluid pressure actuating the control rod (10) will always remain at a constant predetermined pressure to operate the gates (5) & (6) so that there is no leakage possible through the outer periphery of the gate. The seat and the edges of the gates are lined with thick gasket. The pump assembly (17) & (18) will deliver the fluid through pipe (19) to an accumulator (20) for maintaining a constant high fluid pressure to operate the solenoid operated hydraulic valve (SOL). The electronic circuit is also connected with an impulse counter (22) as shown in FIG. 2(*d*) for measuring the quantity of product discharge. Product is released from the twin chamber through a volumetric discharge mechanism (21).

The general operation of the control circuit is described as follows:

Initially, solenoid (SOL) (referred FIGS. 2(*b*) & 2(*d*)) is at off-position since both relays (RL1) & (RL2) as shown in FIG. 2(*d*) are at off-position. When sensor (S1) senses, the level of the material, control circuit CKT1 (FIG. 2(*e*)) closes relay RL1. In other words, when sensor (S1) senses the level of the material, circuit CKT1 closes relay RL1. This will remain on due to latching action of the relays RL1 and RL2 irrespective of signal level at sensor (9*a*). During 'on' period of relay RL1, mains contactor (MC) is also on and the solenoid (SOL) is activated. When sensor (9*b*) or (S1) senses the material level in chamber (Y), circuit CKT2 (FIG. 2(*e*)) closes relay RL2 as shown in FIG. 2(*a*) and FIG. 2(*d*). In other words, when sensor (9*b*) or (S1) senses the material level in chamber (Y), circuit CKT2 closes relay RL2 as shown in FIG. 2(*a*) and FIG. 2(*d*). When relay RL2 is in 'on' position, the latching action of RL1/RL2 interrupts, which makes RL1 off. This in turn opens mains contactor (MC) and solenoid (SOL) is deactivated. Relay (RL1) will remain off until sensor (9*a*) as shown in FIG. 2(*a*) & FIG. 2(*b*) senses the material level again and whole cycle repeats. The impulse counter (22) is connected to one NO point of the mains contactor (MC) which counts the number of repeated cycles of solenoid (SOL) on/off.

The control circuit CKT1 of CKT2 as shown in FIG. 2(*e*) consists of resistors (R1, R3 & potentiometer R2), capacitors (C1, C2, C3, C4), IC, Transistor Tr, light dependent resistance (LDR) sensor (S1 or S2), Relay (RL1 or RL2). The function of the control circuit is very clear from the description with reference to FIG. 2(2) of the drawings.

The novel mechanism of the present invention includes hydraulically operated gates for charging and discharging of the material in the twin chamber compartments being controlled by electronic circuit. This totally eliminates the leakage of air which was not possible through the earlier known systems.

Advantages of the invention:

(i) A hydraulically operated powerful gate which avoids air leakage completely.

(ii) Efficient opening and closing of discharge gates by an electronic circuit.

(iii) Cumulative discharge recorder for measuring kiln capacity at any instant.

(iv) Reduce dust emission.

(v) Efficient discharge mechanism for a process equipment such as vertical shaft kiln, where air leakage with discharge of product is expected.

We claim:

1. A sealing device useful for attachment to a process equipment for providing an air-seal, self-controlled discharge of product from said equipment, which comprises a chamber having at its top end an inlet with a flange for fitting to a discharge chute of said process equipment and a discharge outlet at its bottom end, said chamber being provided with a partition wall having an inlet gate and a discharge gate hinged to its top and bottom respectively, free ends of the hinged gates being such as to sit on air-seal means to provide said air seal, operation means being provided for simultaneous operation of the inlet and discharge gates, said operation means being connected to a control circuit for actuating movement of the gates, the discharge outlet being fitted onto a volumetric discharge unit provided with measuring means for measuring quantity of product discharge.

2. A sealing device as claimed in claim 1 wherein edges of the free ends of the gates and corresponding air-seal means are provided with air-seal gaskets.

3. A sealing device as claimed in claim 2 wherein sensors are provided at the partition wall within said chamber to monitor product level.

4. A sealing device as claimed in claim 1 wherein sensors are provided at the partition wall within said chamber to monitor product level.

5. A sealing device as claimed in claims 1, 2, 4 or 3 wherein hydraulically operated systems are connected to a control circuit through sensors for effecting movements of the gates.

6. A sealing device as claimed in claims 4 or 3 wherein said control circuit is capable of signaling said operation means to simultaneously move the inlet and discharge gates between a first and a second position in response to signals from the sensors when a preselected level of product is discharged into first or second chamber sections, said partition wall dividing the chamber into the first and second chamber sections, when in the first position, the inlet and discharge gates sealing entry to the first chamber section and exit from the second chamber section, and when in the second position, the inlet and discharge gates sealing entry to the second chamber section and exit from the first chamber section, whereby any product entering the inlet is directed into the second chamber section when the inlet gate is in the first position and is directed into the first chamber section when the inlet gate is in the second position, and whereby any product in the first chamber section is discharged therefrom through the discharge outlet when the discharge gate is in the first position, and any product in the second chamber section is discharged therefrom through the discharge outlet when the discharge gate is in the second position.

7. A sealing device as claimed in claims 3 or 6 wherein said control circuit is connected to an impulse counter for measuring the quantity of product discharge.

* * * * *